US010648764B2

(12) United States Patent
Spielberger et al.

(10) Patent No.: US 10,648,764 B2
(45) Date of Patent: May 12, 2020

(54) PROJECTILE LAUNCHER APPARATUS WITH MAGAZINE

(71) Applicant: Hasbro, Inc., Pawtucket, RI (US)

(72) Inventors: Lee Spielberger, Rumford, RI (US); John Paul Lallier, North Attleboro, MA (US); Alan Wong Shing Bun, Hong Kong (HK); Jack Tang Wan Yin, Hong Kong (HK); Martin Leung Hing Tong, Hong Kong (HK)

(73) Assignee: HASBRO, INC., Pawtucket, RI (US)

( * ) Notice: Subject to any disclaimer, the term of this patent is extended or adjusted under 35 U.S.C. 154(b) by 0 days.

(21) Appl. No.: 16/139,073

(22) Filed: Sep. 23, 2018

(65) Prior Publication Data

US 2019/0107358 A1 Apr. 11, 2019

Related U.S. Application Data

(60) Provisional application No. 62/570,246, filed on Oct. 10, 2017.

(51) Int. Cl.
*F41B 7/00* (2006.01)
*F41B 11/89* (2013.01)

(52) U.S. Cl.
CPC ..... *F41B 7/006* (2013.01); *F41B 11/89* (2013.01)

(58) Field of Classification Search
CPC .... F41B 4/00; F41B 7/003; F41B 7/08; F41B 11/54; F41B 11/646; F41B 7/006
USPC ..... 124/32, 41.1, 45, 51.1, 66, 67, 80; 446/473
See application file for complete search history.

(56) References Cited

U.S. PATENT DOCUMENTS 2,737,942 A * 3/1956 Horowitz ..... F41B 7/006 124/37
3,990,426 A * 11/1976 Stokes ..... A63B 69/409 124/56
4,841,945 A * 6/1989 Braden ..... A63B 69/406 124/1
4,850,328 A * 7/1989 Sindel ..... F41A 9/41 124/67
4,890,404 A * 1/1990 Ferri ..... F41C 3/12 124/2
5,284,274 A * 2/1994 Lee ..... F41B 9/0065 124/65
5,471,967 A * 12/1995 Matsuzaki ..... F41B 4/00 124/6
5,771,875 A * 6/1998 Sullivan ..... F41B 11/54 124/72

(Continued)

*Primary Examiner* — Alexander R Niconovich
(74) *Attorney, Agent, or Firm* — Perry Hoffman

(57) ABSTRACT

A toy launcher apparatus of a soft foam dart where the dart is loaded onto a spike in a firing chamber by a pusher panel that presses against the nose of the dart. The apparatus includes a dart magazine with a feed mechanism. The pusher panel is followed by a barrier sleeve that prevents the next uppermost dart in the magazine, which is being biased upward by the feed mechanism, from causing either the uppermost dart or the second uppermost dart to distort and cause a jam. The barrier sleeve also prevents the magazine from being loaded through a top opening until the uppermost dart in the firing chamber is launched. Near the end of a cocking cycle, the pusher panel, which is connected to a cam follower tab that engages a cam member, moves away from a launch path of the dart in the firing chamber.

20 Claims, 14 Drawing Sheets

(56) References Cited

U.S. PATENT DOCUMENTS 6,488,019 B2 * 12/2002 Kotsiopoulos ..... F41B 11/57 124/51.1
7,051,727 B2 * 5/2006 Wu ..... F41B 4/00 124/6
7,458,371 B2 * 12/2008 Ong ..... F41B 11/54 124/59
8,082,909 B2 * 12/2011 Sopinsky ..... A63F 9/02 124/16
8,127,753 B1 * 3/2012 Brooks ..... F41B 11/646 124/66
8,596,254 B2 * 12/2013 Brooks ..... F41B 7/003 124/52
8,662,063 B2 * 3/2014 Hu ..... F41B 11/646 124/41.1
8,695,579 B2 * 4/2014 Huebl ..... F41A 9/26 124/78
8,800,541 B2 * 8/2014 Hu ..... F41B 11/646 124/66
8,967,130 B2 * 3/2015 Victor ..... F41A 19/52 124/16
8,997,727 B1 * 4/2015 Hamel ..... F41B 7/08 124/10
9,134,091 B2 * 9/2015 Busse ..... F41B 11/89
9,194,646 B2 * 11/2015 Victor ..... F41A 19/25
9,389,042 B1 * 7/2016 Clayton ..... F41B 11/642
9,587,903 B2 * 3/2017 Sullivan ..... F41A 9/71
9,958,230 B1 * 5/2018 Nugent ..... F41B 4/00
2002/0166551 A1 * 11/2002 Lee ..... F41B 4/00 124/78
2007/0261689 A1 * 11/2007 Tai ..... F41B 11/646 124/67
2009/0095272 A1 * 4/2009 Zimmerman ..... F41B 4/00 124/78
2013/0112184 A1 * 5/2013 Corsiglia ..... F42B 6/00 124/78
2013/0312722 A1 * 11/2013 Price ..... F41B 15/00 124/1

* cited by examiner

PROJECTILE LAUNCHER APPARATUS WITH MAGAZINE

PRIORITY CROSS-REFERENCE TO RELATED APPLICATION

This application claims priority pursuant to 35 U.S.C. 119(e) or 120 from U.S. Provisional Application No. 62/570,246, filed Oct. 10, 2017.

FIELD OF THE INVENTION

The present invention relates generally to a projectile launcher apparatus and, more particularly, to a compact and lightweight projectile launcher apparatus having the ability to push a projectile, such as a soft foam dart, into a firing chamber while alleviating jamming of the apparatus.

BACKGROUND OF THE INVENTION

Toy launcher apparatus are well known. For example, U.S. Pat. No. 4,843,751 issued to Ferri in 1989 entitled "Toy Firearm Operated By Compress Air, With Magazine In An Element In The Guise Of A Trigger," purport to disclose a toy firearm operated by compressed air and a spring, and the firearm includes a retractable magazine. To cock the firearm a user pulls on a trigger 24/sliding element 16 against a spring 18 and a spring 7. A resilient rocker detent 32 engages a detent 12/rod 10 to displace the rod 10 and a piston 5, and to compress the spring 7. Toward the end of the cocking action the rear end of the detent 32 comes into contact with an inclined surface 14C of a slide housing 14 and the detent 32 is displaced (against a spring 34) until the detent 32 releases the detent 12. At this point the spring 7 propels the piston 5 forward and the compressed air fires the projectile P1.

Another example is U.S. Pat. No. 9,389,042 issued in 2016 to Clayton and entitled "Projectile Launcher." The Clayton patent purports to disclose a projectile launcher having a movable slide 12, which draws a plunger 21 rearwards by engagement of a slide flange 19 and a plunger flange 21a. As the plunger moves rearward a spring 24 is compressed and at an end of the slide movement a trigger latch 23c engages an opening 21c. In one variation, projectiles may be loaded from above the frame 111, FIG. 9.

The earlier patents disclose devices that are complicated and expensive, and neither of the two patents discloses an element pushing a projectile rearward into a barrel nor act as a barrier to prevent jamming from below and above.

SUMMARY OF THE INVENTION

The subject invention solves problems that have plagued launchers that use soft foam darts in that the darts tend to squeeze together and distort under the influence of a biasing feed mechanism. Such distortions cause the launchers to jam. Another problem is that loading darts during play may also cause a distortion and jamming. The present invention solves these problems and provides a compact and lightweight but robust launcher which is fun to play with, easy to use and handle, and which is marketable at a reasonable cost.

Briefly summarized, the invention relates to a projectile launcher apparatus including a housing, a projectile magazine connected to the housing for storing a plurality of projectiles, a firing chamber mounted in the housing, an energy source mounted to the housing rearward of the magazine for launching a projectile, a trigger mounted to the housing for releasing the energy source, and a cocking mechanism operatively connected to the housing and to the energy source, the cocking mechanism being mounted to the housing to move rearward and forward and includes a pusher panel mounted to engage a projectile in the magazine and push the engaged projectile rearward into the firing chamber.

The invention also relates to a method for assembling a toy projectile launching apparatus including the steps of forming a housing, mounting a projectile magazine to the housing for supporting a plurality of toy projectiles and a feed mechanism, mounting a firing chamber in the housing, mounting a trigger to the housing, mounting an energy source to the housing for launching a projectile, and mounting a cocking mechanism to the housing and to the energy source, the cocking mechanism including a retractable pusher panel movable between a first position where the pusher panel is enabled to engage and push an uppermost projectile from the magazine into the firing chamber and a second position where the pusher panel is spaced away from the uppermost projectile and its launch path.

BRIEF DESCRIPTION OF THE DRAWINGS

For the purpose of facilitating an understanding of the invention, the accompanying drawings and detailed description illustrate a preferred embodiment thereof, from which the invention, its structures, its constructions and operations, its processes, and many related advantages may be readily understood and appreciated.

DESCRIPTION OF THE PREFERRED EMBODIMENT

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
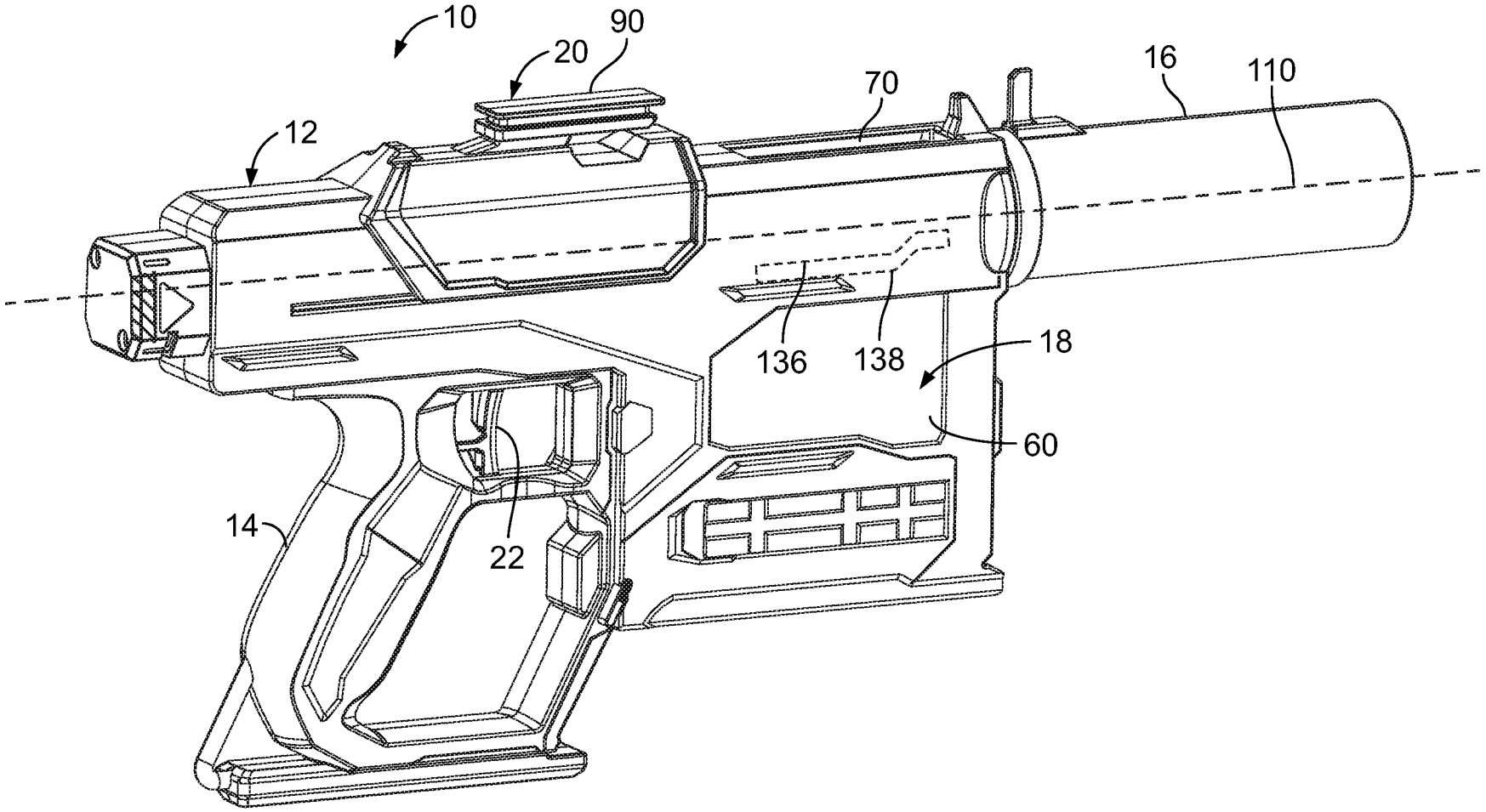
FIG. 1 is an isometric view of a toy launcher apparatus of the present invention with an integral projectile magazine.
Figure 2:
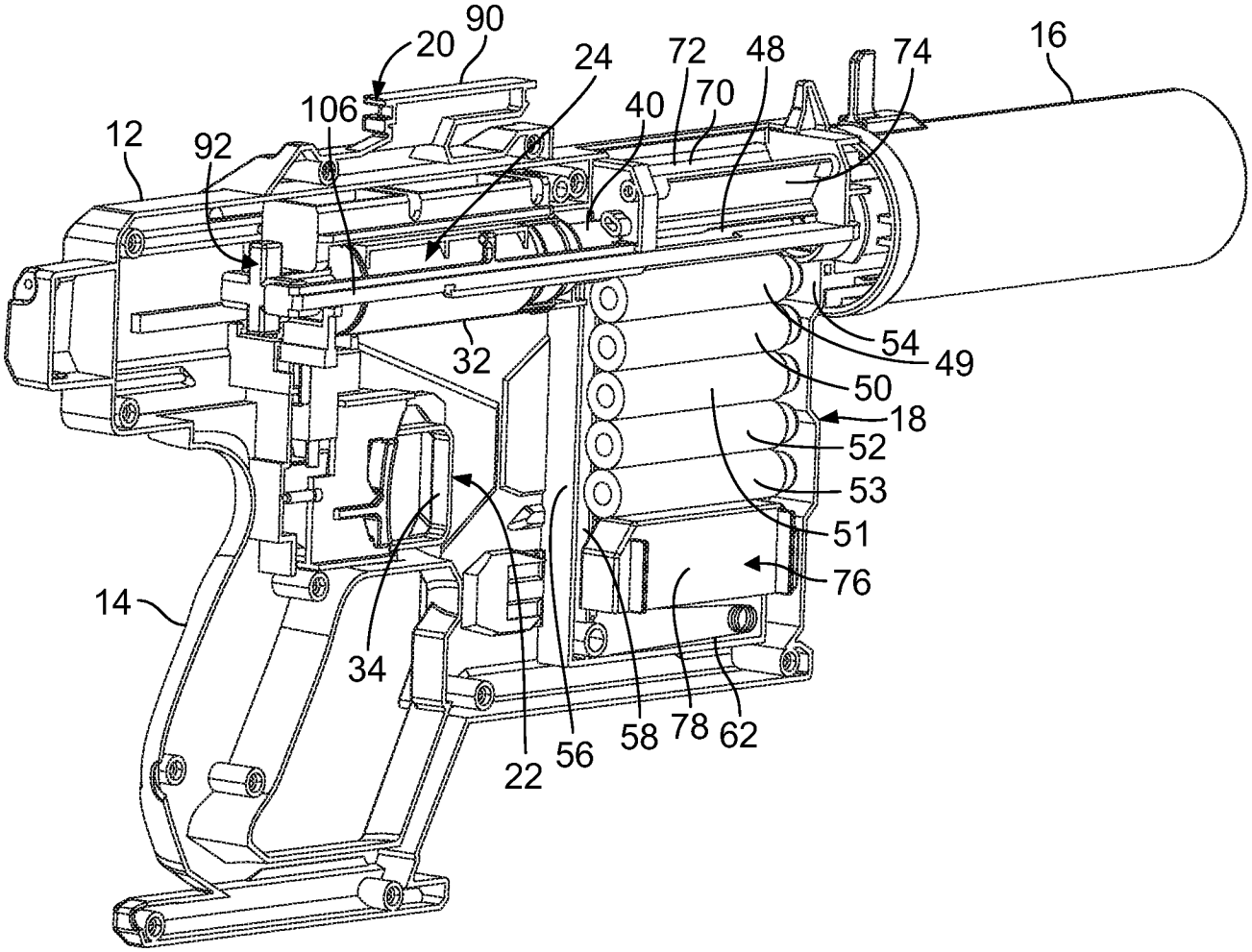
FIG. 2 is an isometric view of the launcher apparatus shown in FIG. 1 with half of a housing removed.
Figure 3:
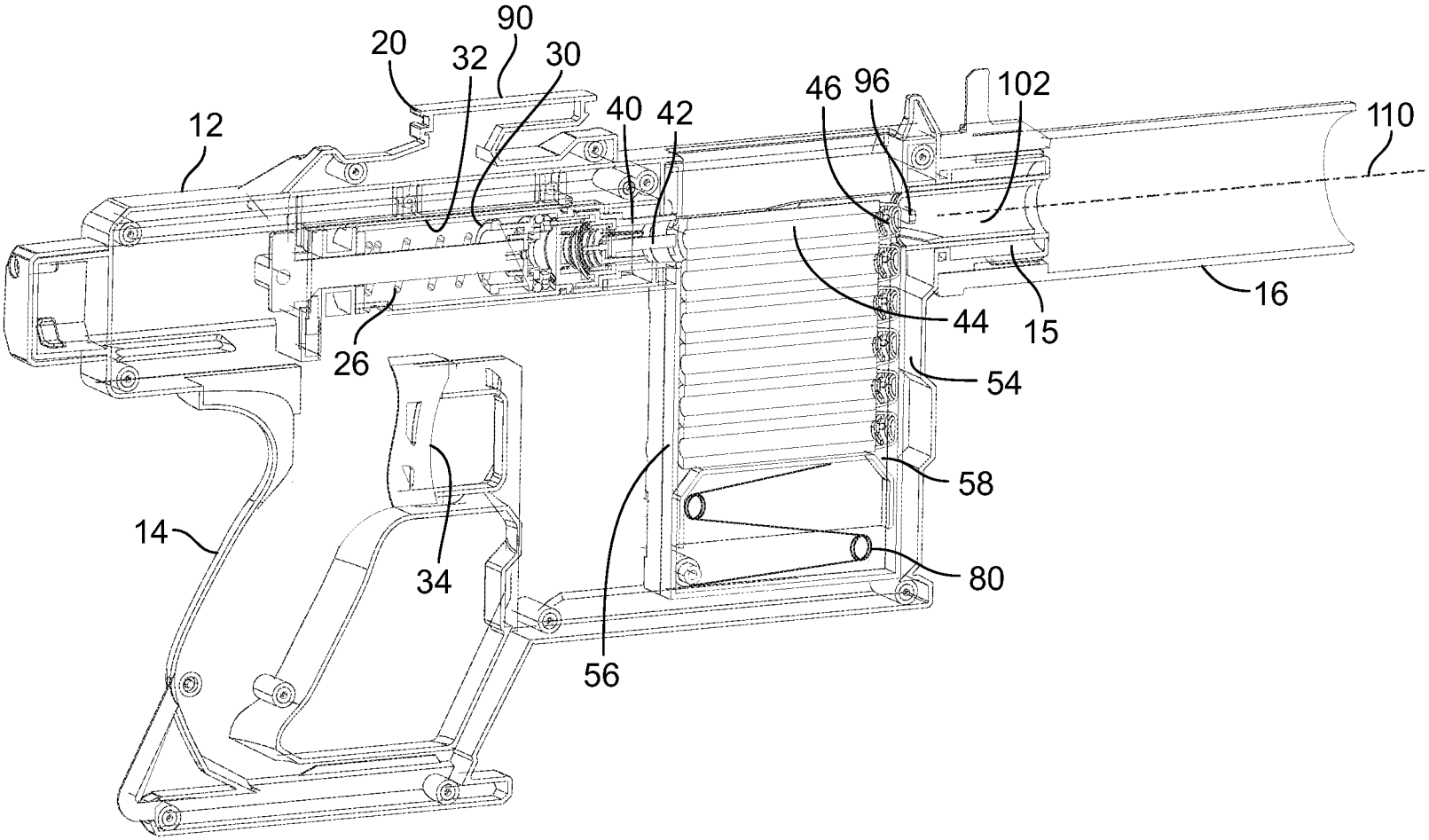
FIG. 3 is an isometric view of the launcher apparatus shown in FIGS. 1 and 2, with portions of the apparatus in cross section.
Figure 4:
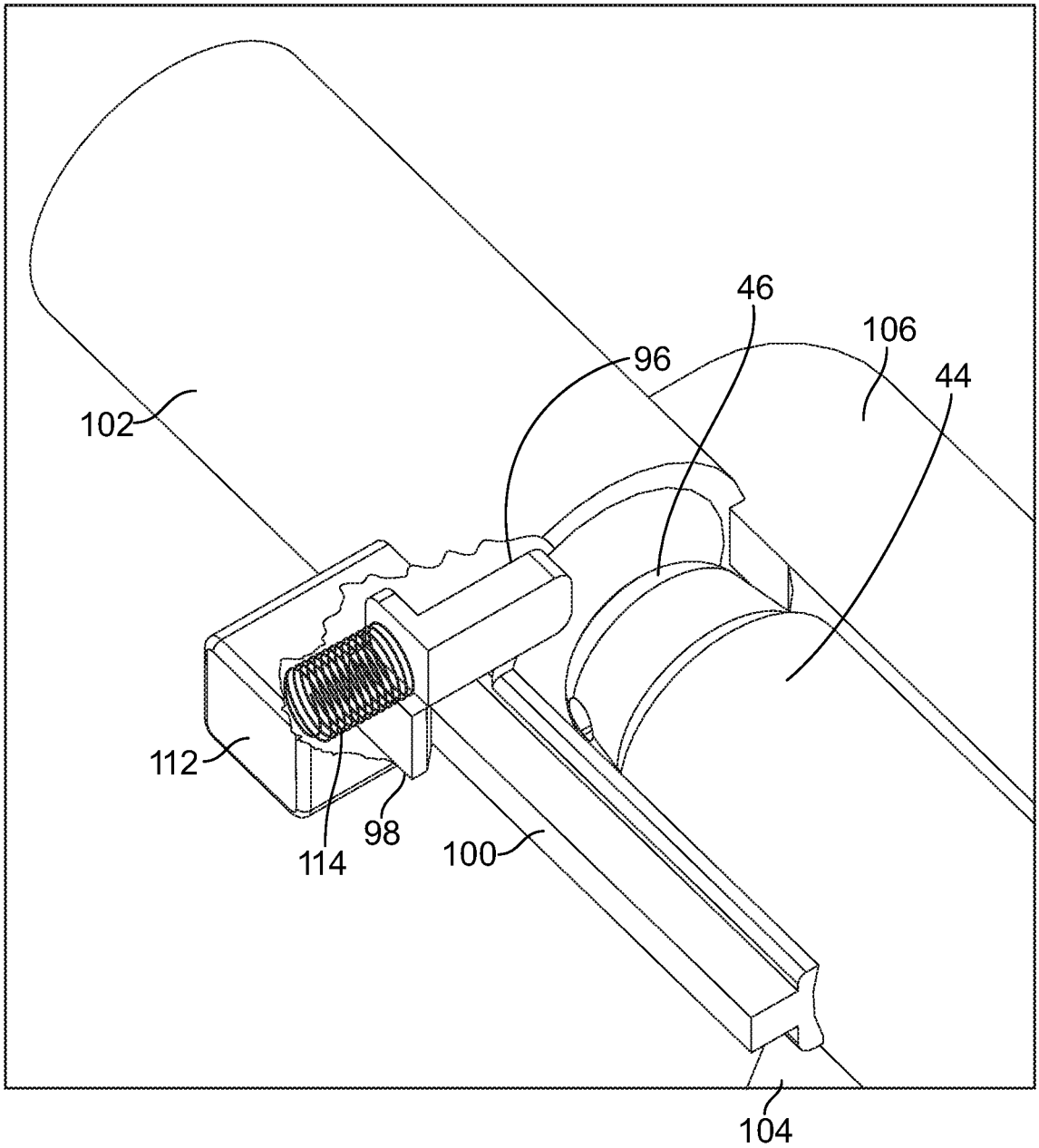
FIG. 4 is an isometric view of a pusher panel, a portion of a dart and a barrier sleeve found in the apparatus shown in FIGS. 1-3.

Referring to FIGS. 1-3, there is illustrated a projectile launcher apparatus 10 of the present invention. The projectile launcher apparatus includes a stylized gun-like outer housing 12 divided generally in half having a rearward located grip portion 14, a forward located short barrel 15, a simulated sound suppressor 16, an integrated projectile magazine 18 mounted or located in the housing in-between the grip portion and the barrel 15, a cocking mechanism 20 mounted to the housing 12 and a trigger mechanism 22 mounted to the housing 12. An energy source 24 for launching a projectile is also mounted to the housing 12. In the alternative, the magazine need not be integral, but may be engaged with the housing in a fashion well known in the toy industry.

The energy source 24, FIG. 2, may be a compressed launch spring 26 created by a cocking piston 30 moved rearward in a cylinder 32. In the alternative, compressed air may be used as an energy source, or some other convenient device well known to those skilled in the art may be used. The trigger mechanism 22 is mounted to the grip portion 14 and includes a trigger pull 34 mounted to the housing 12 for releasing the piston 30 (or the spring or whatever other source is used).

Between the cylinder 32 and the magazine 18 is a firing chamber 40, FIGS. 2 and 3. The firing chamber 40 includes a spike 42 onto which a projectile having a soft foam tubular body, such as a dart 44, FIGS. 3-13, is loaded. Each dart typically includes a nose 46 which may be formed of foam that is somewhat harder or denser than that of the body. Forward of the spike 42 is an upper portion 48, FIG. 2, of the magazine 18 in which the uppermost dart 44 to be launched is positioned. Five additional darts 49, 50, 51, 52, 53, FIGS. 2 and 7, may be stacked beneath the uppermost dart 44.

The magazine 18 may include a front wall 54, FIG. 3, a rear wall 56, two sidewalls 58, 60, FIGS. 1 and 3, and a bottom wall 62, FIG. 2. The magazine 18 also may include an upper opening 70, FIG. 2, having two pivotally mounted doors 72, 74 through which darts may be easily loaded or inserted by a user. Within the magazine 18 below the stack of darts is a feed mechanism 76, FIG. 2, including a spring follower 78 containing a biasing spring 80, FIG. 3, which pushes the stack of darts upward as each dart is launched.

A feature of the launcher apparatus is that a user may load a dart through the upper opening 70 during play at any time after a dart previously loaded into the firing chamber has been launched and before the launcher apparatus has been primed or cocked for a follow-on launch.

A major problem with toy projectile magazines containing soft bodied darts, whether external or internal, as here, is that soft foam darts, such as those marketed under the NERF® brand by the Hasbro Company of Rhode Island, tend to squeeze together under the influence of the biasing spring 80 and the spring follower 78 within the magazine, as the spring attempts to force another dart upward in the magazine. When adjacent darts are pressed together the shape of one or the other or both darts are likely to distort because of their soft bodies. A distortion is likely to cause a jam of the launcher apparatus, and a jam results in disruption of play with the launcher apparatus. A similar distortion problem may result should a user try to load a new dart through the upper opening 70 when the apparatus is going through a cocking cycle or has already been primed. A major feature of the launcher apparatus 10 of the present invention is that the apparatus addresses the jamming problem and provides a solution as will be described in detail below.

Located on top of the housing 12 and a part of the cocking mechanism 20 is a cocking slide 90, FIGS. 1 and 2, which is pulled longitudinally rearward by a user to cock or prime the energy source 24 by moving the piston 30 rearward to compress the spring 26, and then the cocking slide is returned either by the user and/or by a return spring. The slide 90 is also connected to a framework 92, FIG. 2, a pusher panel 96, FIGS. 4, 5 and 7-13, a cam follower tab 98, FIGS. 4 and 7-14, a guide arm 100, FIGS. 4, 6 and 9-11, and a barrier member 102, FIGS. 4 and 6-11, all part of the cocking mechanism 20. Also part of the cocking mechanism 20 is a cam member 104 connected to the housing 12.

Figure 6:
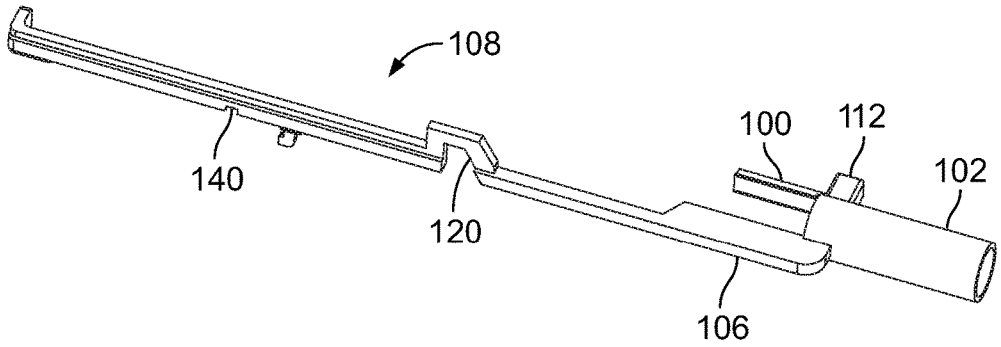
FIG. 6 is an isometric view of an integral item including the sleeve, a guide arm, a box for the pusher panel and a biasing spring, and a long rod.

The framework 92 is positioned on both sides and forward of the magazine 18. On one side is a long rod 106 that is pushed rearward by the cocking slide 90 when the energy source 24 is primed, and on the other side is the pusher panel 96, the cam follower tab 98 integral with and extending downward at a right angle to the pusher panel 96, and the guide arm 100 extending parallel to the rod 106. Forward of the pusher panel 96 is the barrier member in the form of a relatively rigid cylindrical sleeve 102 of any suitable material. The guide arm 100, the long rod 106, a box 112 for the pusher panel 96 and a biasing spring 114, and the barrier sleeve 102 may be molded as an integral element 108 as shown in FIG. 6. The element 108 is mounted to move rearward and forward parallel to a longitudinal axis 110 of the launcher apparatus. The pusher panel 96, mounted in the box 112, moves rearward and forward and also laterally in a direction generally perpendicular to the longitudinal axis 110.

The barrier sleeve 102 (hereinafter "the sleeve") has two functions when the user primes or cocks the launcher apparatus; the first function is to act as a barrier to prevent the next uppermost dart 49 from interfering with the uppermost dart 44. Such interference may cause distortion of the uppermost dart 44, as well as the next uppermost dart 49, because of upward pressure from the adjacent or next uppermost dart 49, and a distortion may cause a jam of the launcher apparatus. As the uppermost dart 44 is pushed rearward by the pusher panel 96 into the firing chamber 40, the sleeve 102 moves into the region formally occupied by the uppermost dart 44 to prevent or block the dart 49 from moving upward. As the sleeve 102 moves rearward it resists upward pressure from the stack of darts and the feed mechanism 76 including the biasing spring 80. The second function of the sleeve 102 is to prevent a dart from being loaded through the top opening 70 when the launcher apparatus is being cocked or after the apparatus has been primed but before launch of the dart in the firing chamber. Thus, the sleeve 102 acts as a block of or barrier to a dart coming through the opening 70; this prevent jamming of the apparatus due to an attempted insertion of a new dart into the magazine at the wrong time.

In the alternative, other structures may be used instead of the sleeve 102. For example, the sleeve may be replaced with upper and lower slats or panels that also have the duel functions of preventing interference from the next uppermost dart from below the dart being loaded into the firing chamber to prevent a jam inducing distortion, and preventing an introduction of a new dart through the top opening of the apparatus to also prevent a jam inducing distortion.

Figure 5:
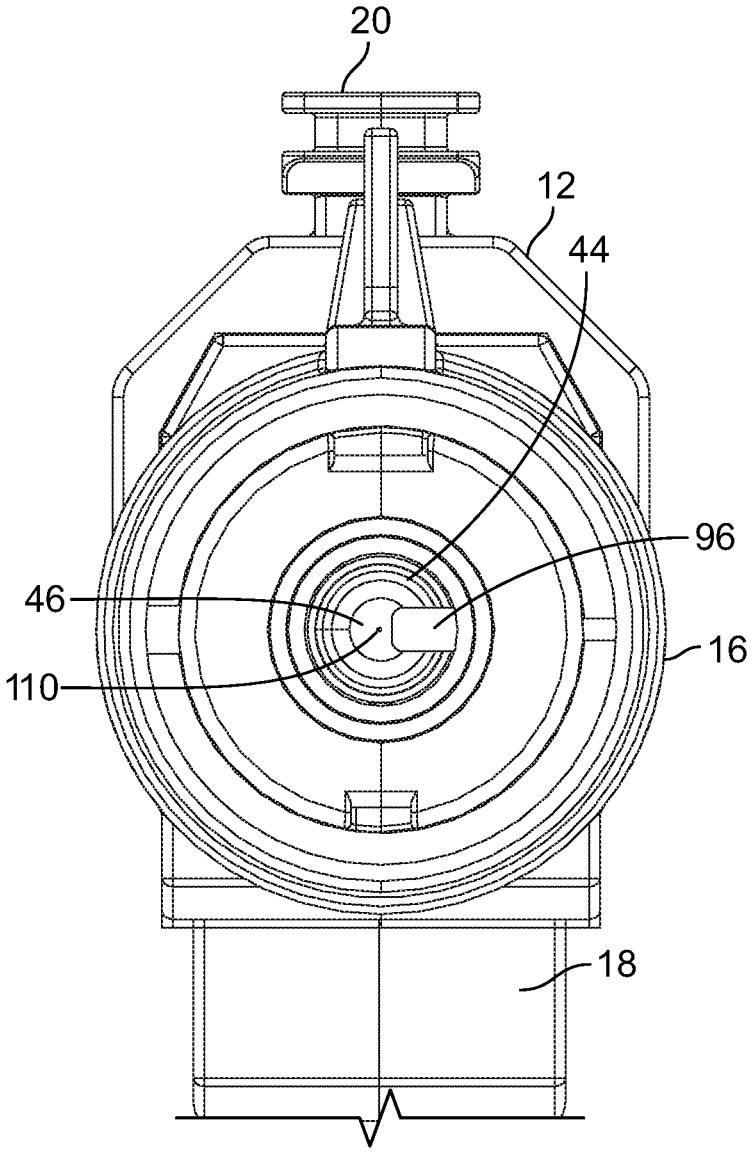
FIG. 5 is an enlarged partial front elevation view of the launcher apparatus shown in FIGS. 1-3.
Figure 7:
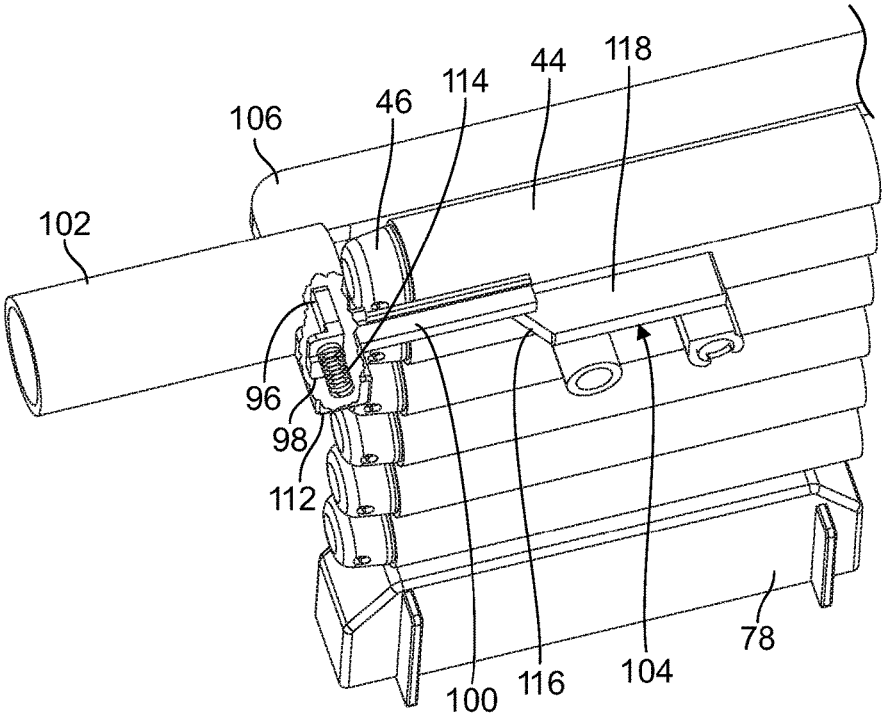
FIG. 7 is a downward looking isometric view of the magazine, a stack of darts, the sleeve and the pusher panel.
Figure 8:
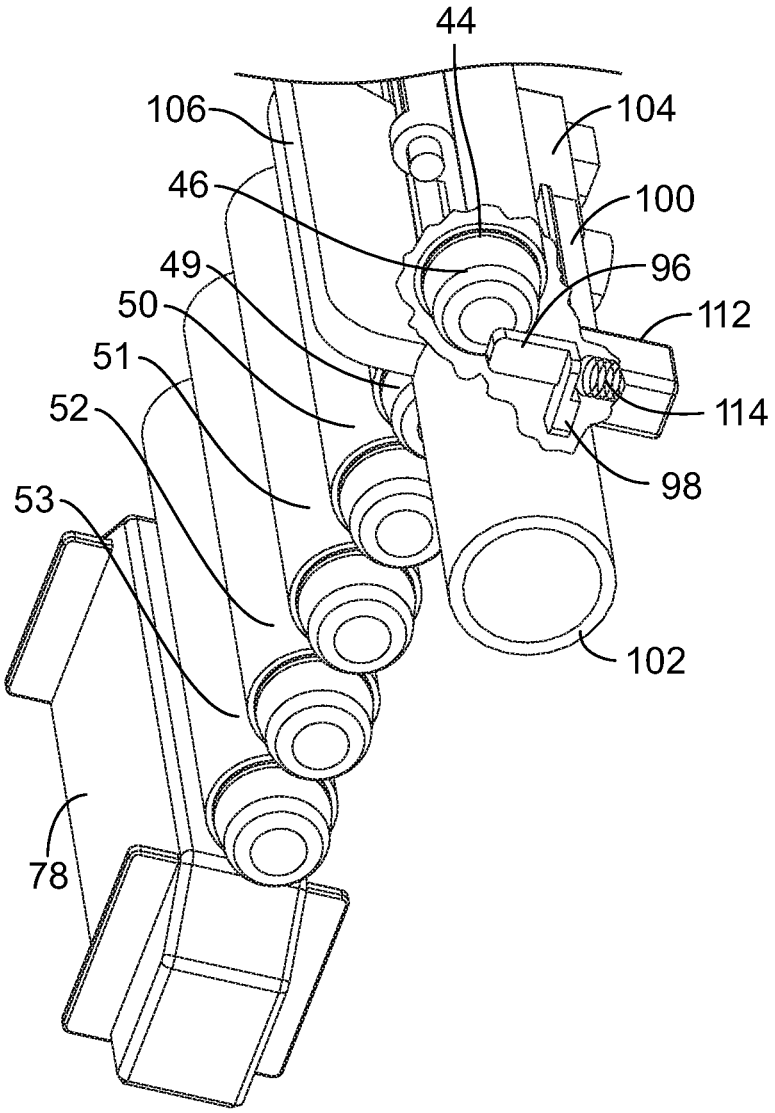
FIG. 8 is a front looking isometric view of the magazine, the darts, the sleeve and the pusher panel.
Figure 12:
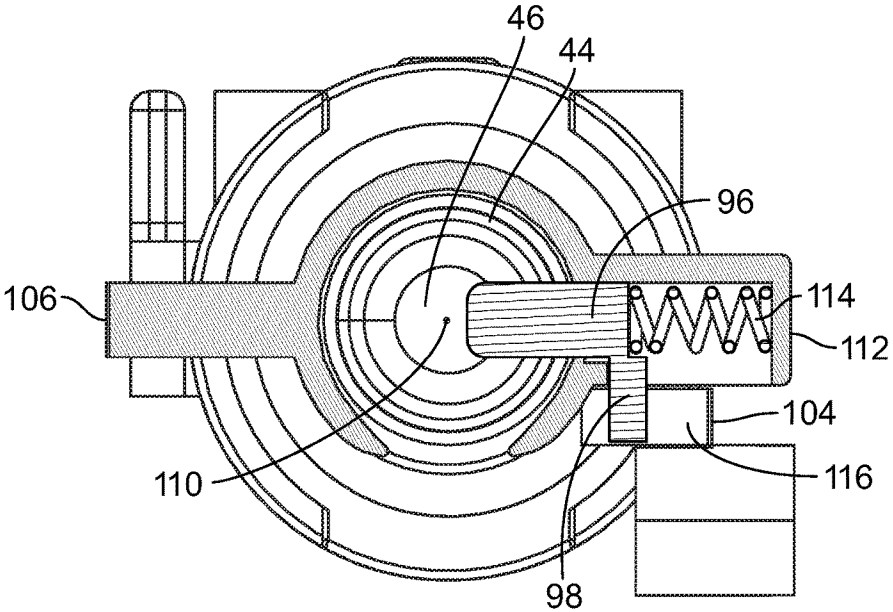
FIG. 12 is an enlarged section view taken along line 12-12 of FIG. 9.

Before the user begins a cocking cycle, the pusher panel 96 is in a first position extending generally perpendicular into the longitudinal axis 110 which is also a launch path of the uppermost dart 44 as shown from the front in FIGS. 5 and 12, from the side in FIG. 3, and from other angles in FIGS. 7 and 8. The term 'launch path' is used to define the path taken by a launched dart as it exits the launcher apparatus. The pusher panel 96 is packaged in the box 112 that also includes the biasing spring 114 to initially keep the pusher panel 96 extended into the longitudinal axis/launch path 110 during the early part of the cocking cycle ensuring that the pusher panel 96 will press against the uppermost dart 44 and move the dart 44 into the firing chamber 40. The cam follower tab 98 is fixed to descend at about a right angle from the pusher panel 96 allowing the cam follower tab 98 to engage the cam member 104, FIGS. 4, 7 and 9-14, when the cocking slide 90 and the pusher panel are at about their most rearmost positions.

Figure 9:
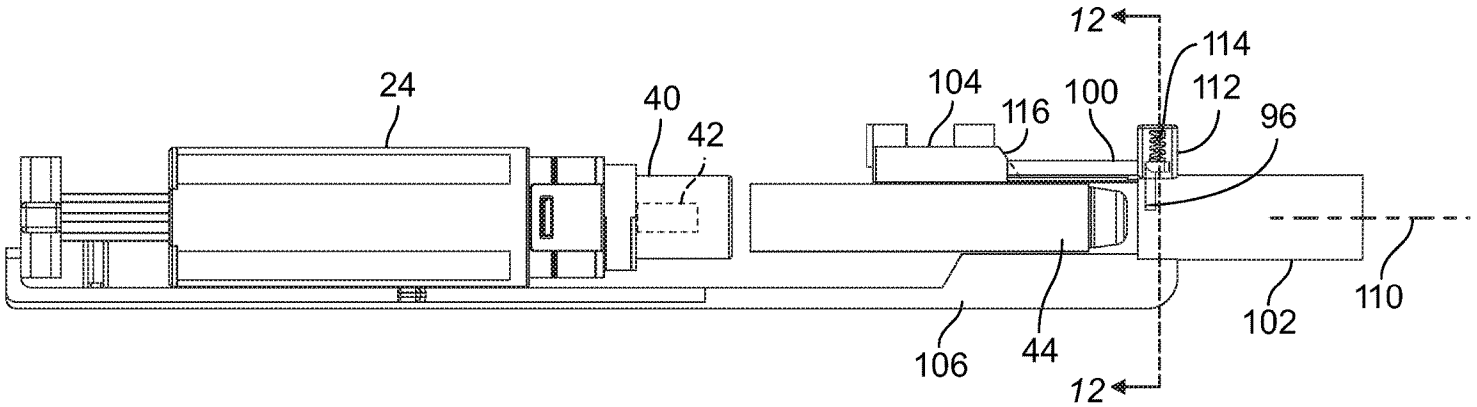
FIG. 9 is a top plan view of the pusher panel, an uppermost dart, the sleeve, a firing chamber and part of a cocking mechanism before beginning a cocking cycle of the apparatus.
Figure 10:
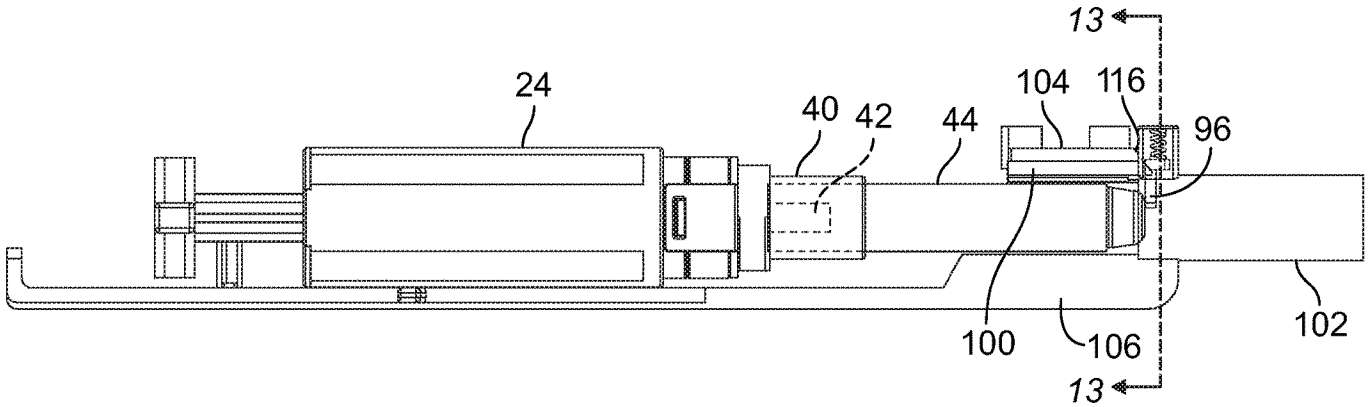
FIG. 10 is a top plan view like that shown in FIG. 9, with the cocking mechanism moved partially rearward and the dart loaded into the firing chamber.
Figure 11:
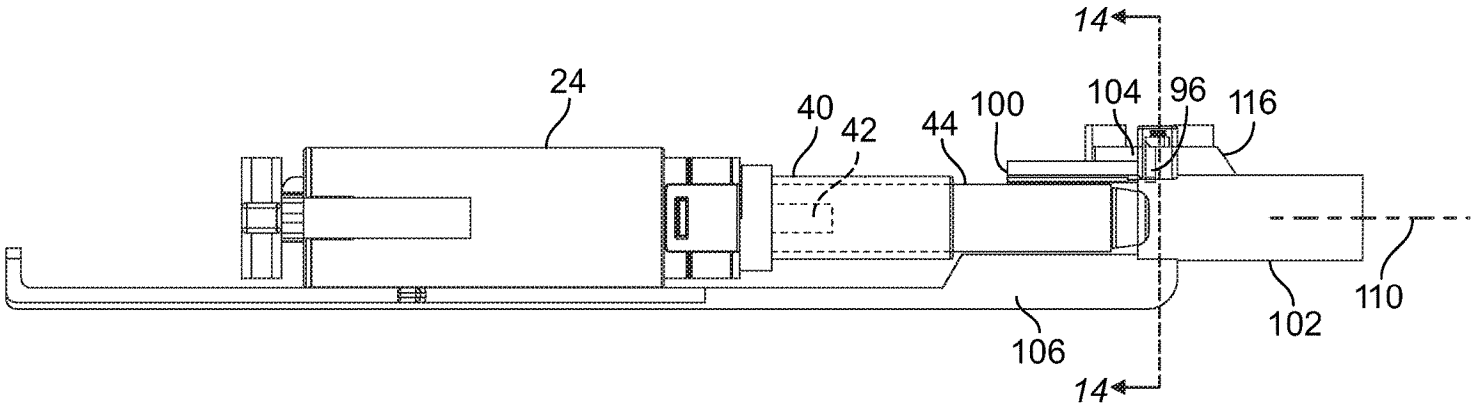
FIG. 11 is a top plan view like that shown in FIGS. 9 and 10, with the cocking mechanism moved fully rearward and a clear launch path for the loaded dart.

The cam member 104 is mounted to the interior of the housing 12 rearward of the pusher panel 96 so as to meet the cam follower tab 98 late in the cocking cycle. The cam member 104 includes a forward slanted cam surface 116, FIG. 17, and a top surface 118. The cocking cycle includes moving the slide 90 in a rearward direction over the grip portion 14, which causes the element 108, FIG. 6, to also move rearward. This rearward movement primes the energy source 24 while at the same time the pusher panel 96 engages the nose 46 of the uppermost dart 44 to push the dart into the firing chamber 40 and over the spike 42 as shown in FIGS. 9-11.

The cam member 104 is positioned to allow the guide arm 100 to slide along the top surface 118, which acts to correctly position the guide arm. After the dart 44 is pushed into the firing chamber, the cam follower tab 98 meets the cam surface 116 to move the cam follower tab 98 and the attached pusher panel 96 from the first position against the nose 46 of the dart 44 to a laterally retracted second position. This movement is also shown in FIGS. 9-14. As the cocking cycle concludes and the element 108 reaches it most rearward position, the cam surface 116 of the cam member 104 engages the cam follower tab 98 and forces the attached pusher panel 96 to move laterally or retract out of the way of the longitudinal axis/launch path 110. Simultaneously, the sleeve 102 moves longitudinally rearward to prevent or block the next uppermost dart 49 from moving upward and interfering with the uppermost dart 44. Keeping the dart 49 from moving against the dart 44 blocks a jam inducing distortion of the darts. The sleeve 102 also blocks the upper opening 70 so that any attempt to load a new dart during the cocking cycle or after conclusion but before launch is prevented and the attempt does not cause any jam inducing distortion of the darts.

Figure 15:
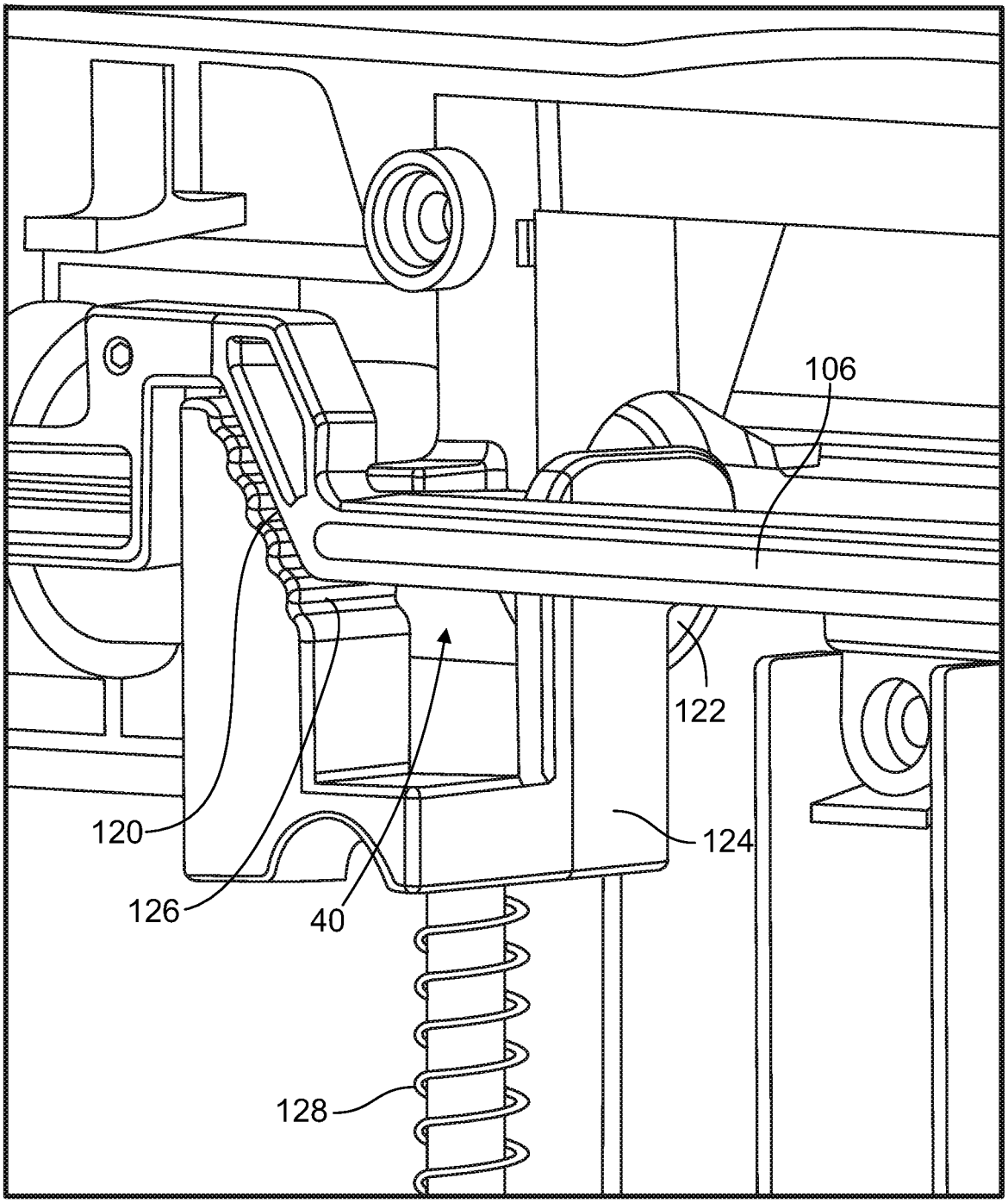
FIG. 15 is an enlarged view of a blocking panel in front of the firing chamber.
Figure 16:
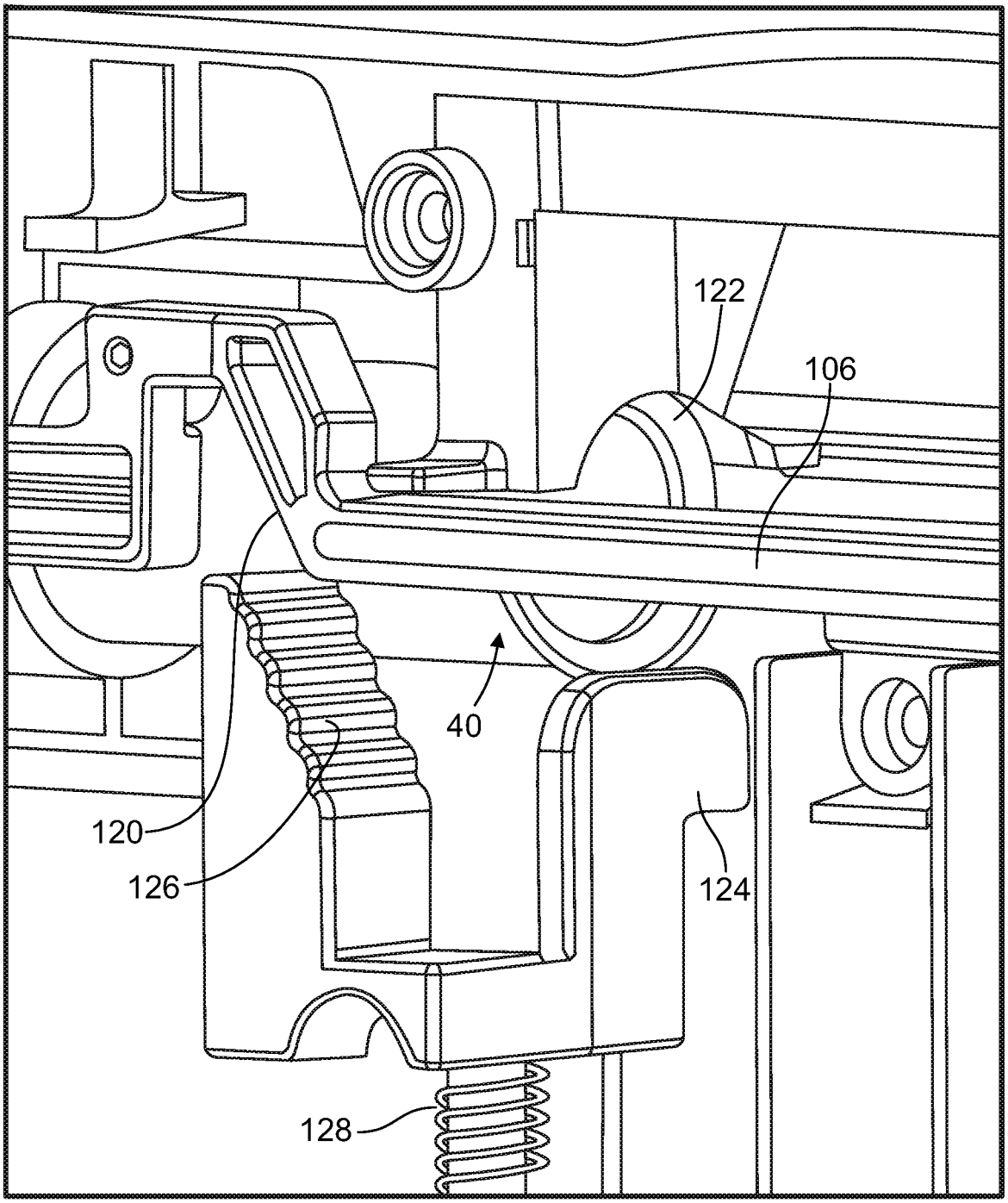
FIG. 16 is an enlarged view of the blocking panel positioned away from the firing chamber.

Another mechanism that is incorporated in the launcher apparatus 10 prevents a dart from being inadvertently loaded into the firing chamber 40 or snagged by it. It is understood that the launcher apparatus may be oriented in different positions when handled during play. Should a user hold the launch apparatus with the barrel 15 and suppressor 16 in an upright position during loading, a dart may inadvertently slide into the chamber 40, a dart might snag on the chamber opening when the user attempts to load the dart. Referring to FIGS. 15 and 16, the mechanism includes a raised cam surface 120 on the long rod 106, the cam surface being located near a front end 122 of the firing chamber 40. The mechanism also includes a vertically movable blocking panel 124 that may be integral with a cam follower 126, the panel 124 and the cam follower 126 being mounted with a spring 128 for biasing the blocking panel and the cam follower upwards.

When the cocking cycle begins and the long rod 106 is moved rearward, the cam surface 120 engages with the cam follower 126 causing the panel 124, normally in an upward blocking or closed position in front of the front end 122 of the chamber 40, as shown in FIG. 15, to be forced downward to an unblocking or open position as shown in FIG. 16. After the long rod 106 is returned forward, the biasing spring 128 pushes the panel into the closed position to again block the chamber 40.

Figure 17:
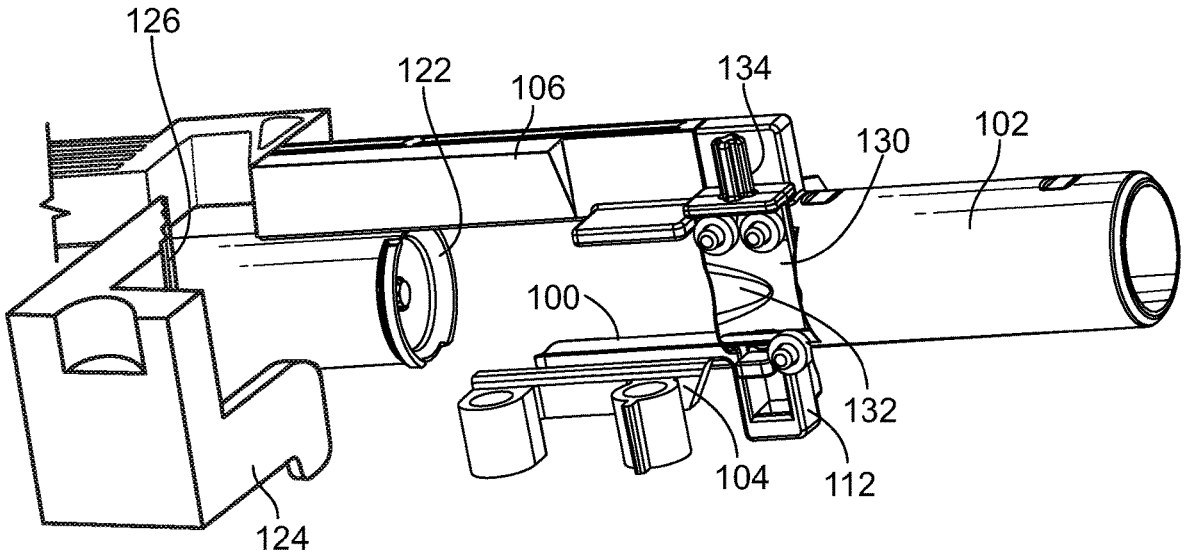
FIG. 17 is an upward looking isometric view of an inverted scoop.

Another element 130, FIG. 17, to help prevent distortion of the second most uppermost dart 49, FIG. 8, is located to the rear and beneath the sleeve 102. The element 130 is bridge like and includes an inverted scoop surface 132 for guiding the sleeve 102 while gradually depressing the dart 49 as the sleeve is drawn rearward as the launcher 10 is primed or cocked. A slide post 134 extends laterally and moves between two rails 136, 138, FIG. 1, (shown in dotted lines) formed on the inside of the housing 12 for helping to guide the scoop surface 132 and sleeve 102 over the next uppermost dart 49.

A notch 140, FIG. 6, in the long rod 106 may receive a spring-biased tab to lock the long rod in its rearward (cocked) position until the trigger is pulled. Pulling the trigger disengages the tab from the rod.

Figure 13:
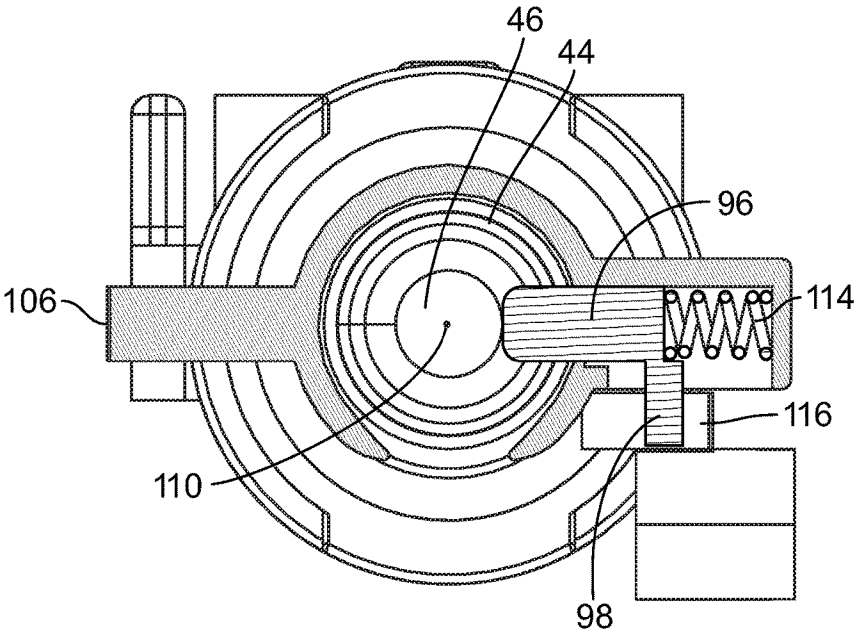
FIG. 13 is an enlarged section view taken along line 13-13 of FIG. 10.
Figure 14:
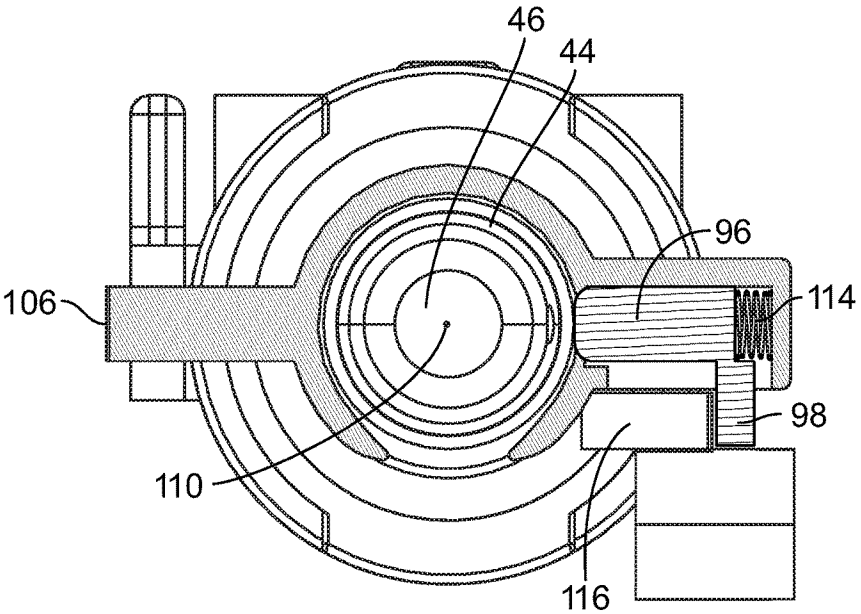
FIG. 14 is an enlarged section view taken along line 14-14 of FIG. 11.

In operation, the user of the launcher apparatus 10 begins a cocking cycle by gripping the slide 90 and moving it rearward away from the barrel 15 and the suppressor 16. At the beginning of the cocking cycle the firing chamber 40 is unblocked and the pusher panel 96 begins it rearward movement. Initially, the pusher panel is in a first extended position generally perpendicular to the longitudinal axis/launch path 110 as shown in FIGS. 3-5, 7-9 and 12. As the user pulls the slide 90 rearward, the sleeve 102, the guide arm 100, the cam follower tab 98 and the pusher panel 96 also move rearward as shown in FIGS. 10 and 13. The guide arm 100 slides along the upper surface 118 of the cam member 104. The cam follower tab 98 and the pusher panel 96 do not change their lateral positions where the pusher panel presses against the dart, until the cam follower tab 98 contacts the slanted cam surface 116 of the cam member 104 near the end of the rearward movement of the dart and the pusher panel. When the tab 98 reaches the slanted cam surface 116, the tab 98 and the attached pusher panel 96 are forced to move from their first positions as shown in FIGS. 9 and 12, to the laterally retracted second positions as shown in FIGS. 11 and 14, with an intermediate position shown in FIGS. 10 and 13.

In the meantime, the pusher panel 96 initially contacts or engages the nose 46 of the uppermost dart 44, and with the sleeve 102 as a guide, pushes the dart 44 rearward onto the spike 42 in the chamber 40. As the uppermost dart 44 moves rearward, the barrier sleeve 102 also moves rearward to restrain the next or second uppermost dart 49 from moving upward and causing a jam producing distortion. Hence, the sleeve 102 acts as the barrier to prevent the next uppermost dart 49 from interfering with the uppermost dart 44 because the next uppermost dart is being biased upward by the feed mechanism 76. The sleeve 102 prevents the uppermost and the next uppermost or adjacent darts from being squeezed together, distorting and causing a jam. At the same time the barrier sleeve 102 blocks the space above the uppermost dart such that a user is unable to load another dart through the upper opening 70 of the magazine until after the dart being primed is launched. When in the second position as shown in FIGS. 11 and 14, the pusher panel 96 is spaced away from the nose 46 of the dart 44, the biasing spring 114 is compressed, and the launch path of the dart 44 is cleared. The element 108 returns to a forward position when the piston is release and the dart 44 is launched.

In the alternative, the framework may take any suitable form, and the cam member and cam follower tab may have different shapes and they may be located differently. The projectiles may be shaped differently and may be made of any suitable material. The pusher panel may be mounted to rotate or pivot out of the way instead of being retractable, and perimeter or other lighting may be used to highlight the launcher's profile and/or simulate a laser aiming light.

It is noted that throughout this description, words such as "forward," "rearward," "front," "rear," and "upper" as well as similar positional terms, refer to portions or elements of the launcher apparatus as they are viewed in the drawings relative to other portions, or in relationship to the positions of the apparatus as it will typically be held and moved during play by a user, or to movements of elements based on the configurations illustrated.

Figure 18:
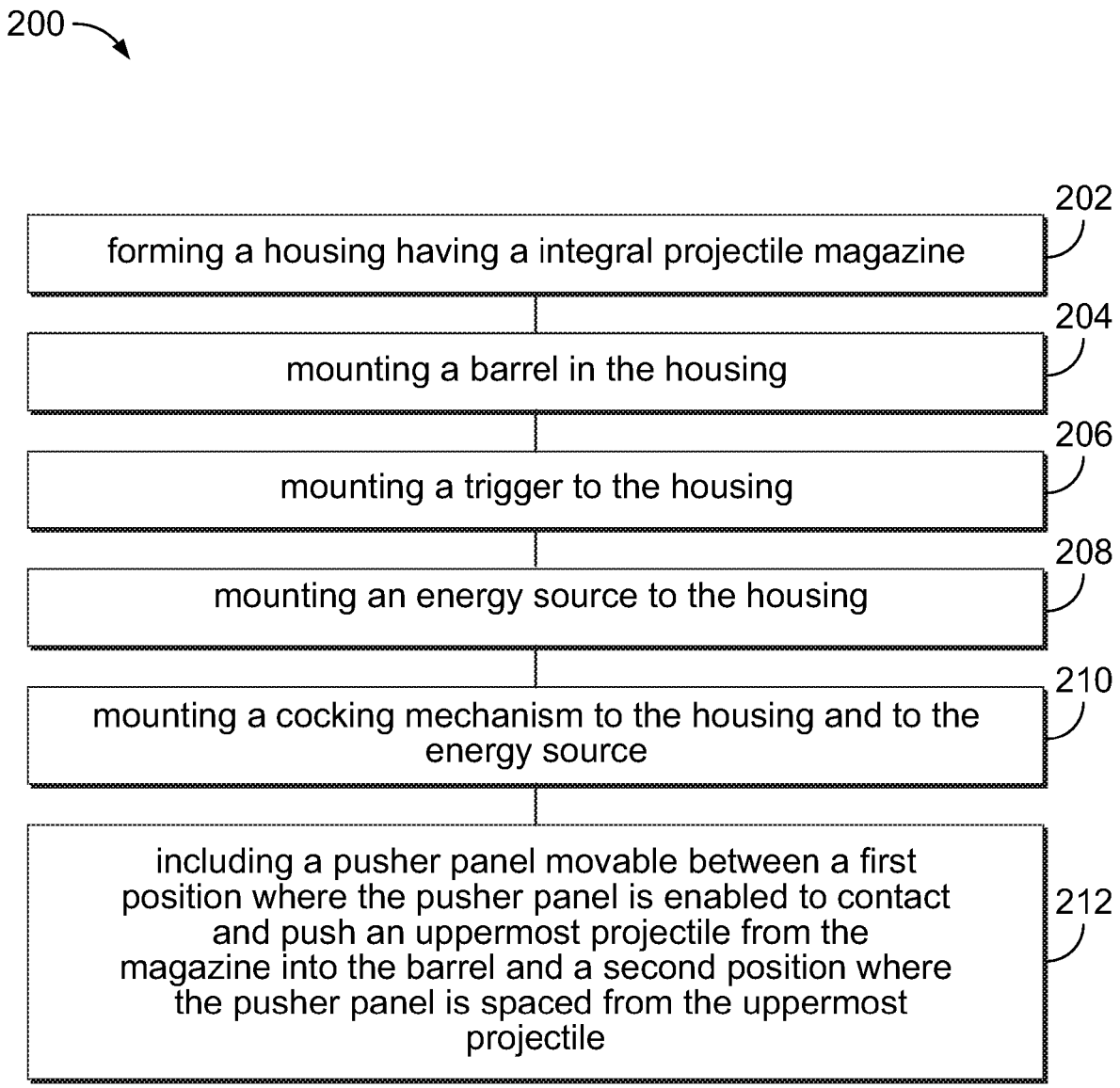
FIG. 18 is a flow diagram of a method for making the launcher apparatus of the present invention.

The present invention includes a method for assembling a toy projectile launcher apparatus 200, FIG. 18, including the steps of forming a housing, mounting a projectile magazine to the housing for supporting a plurality of toy projectiles and a feed mechanism, mounting a firing chamber in the housing 204, mounting a trigger to the housing 206, mounting an energy source 208 to the housing for launching a projectile, and mounting a cocking mechanism to the housing and to the energy source 210, the cocking mechanism including a pusher panel movable between a first position where the pusher panel is enabled to engage and push an uppermost projectile from the magazine into the firing chamber and a second position where the pusher panel is spaced from the uppermost projectile 212 and its launch path. Simultaneously the pusher panel moves rearward along the longitudinal axis of the launcher apparatus 10.

It may now be appreciated that the launcher apparatus disclosed in detail above has great play value, is fun to use and easy to operate. The launcher apparatus is impact, lightweight and yet robust, and has a simple structure that may be produced at reasonable cost.

From the foregoing, it can be seen that there has been provided a detailed description and features for an improved toy launcher apparatus as well as a disclosure of a method for assembling the launcher apparatus. While a particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A projectile launcher apparatus comprising:

a housing;

a projectile magazine connected to the housing for storing a plurality of projectiles;

a firing chamber mounted in the housing;

an energy source mounted to the housing rearward of the magazine for launching a projectile;

a trigger mounted to the housing for releasing the energy source; and a cocking mechanism operatively connected to the housing and to the energy source, the cocking mechanism being mounted to the housing to move rearward and forward and includes a pusher panel mounted to engage a projectile in the magazine and push the engaged projectile rearward into the firing chamber.

2. The apparatus as claimed in claim 1, wherein:

the pusher panel moves rearward and forward with the cocking mechanism and also laterally from a first projectile engaging position to a second position spaced away from a launch path of the projectile.

3. The apparatus as claimed in claim 2, wherein:

the pusher panel is located in the launch path of the engaged projectile when in the first position.

4. The apparatus as claimed in claim 3, wherein:

the pusher panel is connected to a cam follower tab; and the cocking mechanism includes a cam member mounted to the housing wherein the cam member and cam follower tab enable the pusher panel to move from the first position to the second position.

5. The apparatus as claimed in claim 1, wherein:

the magazine is located forward of the firing chamber and the energy source.

6. The apparatus as claimed in claim 1, wherein:

the cocking mechanism includes a barrier member for preventing a next to uppermost projectile in the magazine from interfering with an uppermost projectile in the magazine.

7. The apparatus as claimed in claim 1, wherein:

the cocking mechanism includes a barrier member for preventing insertion of a projectile above an uppermost projectile in the magazine.

8. The apparatus as claimed in claim 7, wherein:

the barrier member prevents a next uppermost projectile in the magazine from interfering with the uppermost projectile in the magazine.

9. The apparatus as claimed in claim 8, wherein:

the pusher panel moves rearward and forward with the cocking mechanism and also laterally from a first projectile engaging position to a second position spaced away from a launch path of the projectile.

10. The apparatus as claimed in claim 9, wherein:

in the first position the pusher panel is located in a launch path of the engaged projectile.

11. The apparatus as claimed in claim 10, wherein:

the pusher panel is connected to a cam follower tab; and the cocking mechanism includes a cam member mounted to the housing wherein the cam member and the cam follower tab enable the pusher panel to move from the first position to the second position.

12. The apparatus as claimed in claim 11, wherein:

the magazine is located forward of the firing chamber and the energy source.

13. A toy dart launcher apparatus comprising:

a housing;

a dart magazine connected to the housing to enable support of a plurality of soft foam toy darts and a feed mechanism;

a firing chamber mounted in the housing;

a trigger mounted to the housing;

an energy source mounted to the housing for launching a dart; and a cocking mechanism operatively connected to the housing and to the energy source, the cocking mechanism including a barrier mounted to the housing to prevent a next to uppermost dart in the magazine from interfering with an uppermost dart and to prevent loading of a dart until after the uppermost dart is launched, a pusher panel connected to the barrier and movable between a first position where the pusher panel is enabled to engage and push the uppermost dart rearward into the firing chamber and a second position where the pusher panel is enabled to move laterally away from the dart in the firing chamber, a cam follower tab mounted to the pusher panel for moving with the pusher panel, and a cam member mounted to the housing for engaging the cam follower tab for moving the pusher panel from the first position to the second position.

14. The apparatus as claimed in claim 13, wherein:

the barrier selectively prevents insertion of a dart into the top of the magazine.

15. The apparatus as claimed in claim 14, wherein:

the pusher panel moves laterally to a longitudinal axis of the launch apparatus when moving from the first position to the second position.

16. The apparatus as claimed in claim 15, wherein:

in the first position the pusher panel is located in a launch path of the uppermost dart and in the second position the pusher panel is located spaced away from the launch path of the dart in the firing chamber.

17. A method for assembling a toy projectile launching apparatus comprising the steps of:

forming a housing;

mounting a projectile magazine to the housing for supporting a plurality of toy projectiles and a feed mechanism;

mounting a firing chamber in the housing rearward of the magazine;

mounting a trigger to the housing;

mounting an energy source to the housing for launching a projectile; and mounting a cocking mechanism to the housing and to the energy source, the cocking mechanism including a pusher panel wherein the pusher panel is enabled to engage and push an uppermost projectile rearward into the firing chamber.

18. The method of claim 17, including the steps of:

establishing a linear launch path for the projectile in the housing;

establishing a first position for the pusher panel in the launch path and a second position spaced away from the launch path;

mounting a cam follower tab to the pusher panel for moving with the pusher panel; and mounting a cam member to the housing for engaging the cam follower tab to move the pusher panel from the first position to the second position.

19. The method of claim 18, including the step of:

mounting a barrier to the cocking mechanism to prevent an adjacent projectile in the magazine from interfering with an uppermost projectile and causing a jam inducing distortion.

20. The method of claim 19, wherein:

the barrier prevents insertion of a projectile above the uppermost projectile.

* * * * *